US008733420B2

(12) United States Patent
Craney

(10) Patent No.: US 8,733,420 B2
(45) Date of Patent: May 27, 2014

(54) DOOR FOR CLOSING AN OPENING IN A WALL

(75) Inventor: Jens Craney, Melle (DE)

(73) Assignee: Troodon Torsysteme GmbH, Melle (DE)

( * ) Notice: Subject to any disclaimer, the term of this patent is extended or adjusted under 35 U.S.C. 154(b) by 267 days.

(21) Appl. No.: 13/106,589

(22) Filed: May 12, 2011

(65) Prior Publication Data

US 2012/0111507 A1 May 10, 2012

(30) Foreign Application Priority Data

May 17, 2010 (DE) ..... 10 2010 020 693

(51) Int. Cl.
*E06B 9/56* (2006.01)

(52) U.S. Cl.
USPC ..... 160/241; 160/262; 160/310

(58) Field of Classification Search
USPC ..... 160/238, 241, 262, 266, 310, 98, 179, 160/133
See application file for complete search history.

(56) References Cited

U.S. PATENT DOCUMENTS

| | | | | |
|---|---|---|---|---|
| 1,345,447 | A * | 7/1920 | Johnson | 160/382 |
| 2,328,257 | A * | 8/1943 | Butts | 160/121.1 |
| 2,493,125 | A * | 1/1950 | Foster | 219/213 |
| 3,539,767 | A * | 11/1970 | Eisler | 219/213 |
| 4,039,019 | A * | 8/1977 | Hopper | 160/121.1 |
| 4,194,550 | A * | 3/1980 | Hopper | 160/121.1 |
| 4,506,720 | A * | 3/1985 | Iwanicki | 160/26 |
| 4,633,927 | A * | 1/1987 | Labelle | 160/133 |
| 5,275,223 | A * | 1/1994 | Magro et al. | 160/191 |
| 5,351,743 | A * | 10/1994 | Jackson | 160/310 |
| 5,460,216 | A * | 10/1995 | Hirao et al. | 160/133 |
| 5,538,065 | A * | 7/1996 | G eraud | 160/85 |
| 5,544,690 | A | 8/1996 | Magro | |
| 5,620,039 | A * | 4/1997 | Delgado et al. | 160/265 |
| 7,281,561 | B2 * | 10/2007 | Anderson et al. | 160/121.1 |
| 7,614,439 | B2 * | 11/2009 | Lukos | 160/392 |
| 8,113,266 | B2 * | 2/2012 | Cloninger et al. | 160/310 |
| 2010/0024992 | A1 * | 2/2010 | Cloninger et al. | 160/311 |
| 2010/0037522 | A1 * | 2/2010 | Wirth et al. | 49/31 |
| 2010/0162629 | A1 * | 7/2010 | Wirth et al. | 49/360 |
| 2010/0243175 | A1 * | 9/2010 | Gonzales et al. | 160/7 |
| 2011/0011542 | A1 * | 1/2011 | Kuroi | 160/133 |
| 2011/0265959 | A1 * | 11/2011 | Frede | 160/133 |
| 2012/0111507 | A1 * | 5/2012 | Craney | 160/120 |
| 2012/0318465 | A1 * | 12/2012 | Colson | 160/7 |

FOREIGN PATENT DOCUMENTS

| | | | |
|---|---|---|---|
| AT | 507728 | A2 | 7/2010 |
| DE | 19625215 | C2 | 1/1998 |
| DE | 10327339 | B4 | 2/2005 |
| DE | 102005049585 | B3 | 7/2007 |
| DE | 102008014014 | A1 | 9/2008 |
| EP | 1126124 | B1 | 8/2001 |

OTHER PUBLICATIONS

German Patent Office search report.

* cited by examiner

*Primary Examiner* — Katherine Mitchell
*Assistant Examiner* — Abe Massad
(74) *Attorney, Agent, or Firm* — Laurence P. Cotton; Smith Risley Tempel Santos LLC

(57) ABSTRACT

A door for closing an opening in a wall, preferably a wall which separates two different temperature zones from one another, in particular one belonging to a cold store, having a door leaf (22), which can be moved in front of the wall opening, and having a heater for heating at least one door component.

13 Claims, 5 Drawing Sheets

DOOR FOR CLOSING AN OPENING IN A WALL

STATEMENT OF RELATED APPLICATIONS

This patent application is based on and claims the benefit of German patent application number 10 2010 020 693.8 having a filing date of 17 May 2010, which is incorporated herein in its entirety by this reference.

BACKGROUND OF THE INVENTION

1. Technical Field

The present invention relates to a door for closing an opening in a wall, preferably a wall which separates two different temperature zones from one another, in particular one belonging to a cold store, having a door leaf, which can be moved in front of the wall opening, and having a heater for heating at least one door component. The invention also relates to a door leaf for such a door. The invention additionally relates to a winding-up shaft for winding up a door leaf or part of the leaf of a rolling door for closing a wall opening, wherein the winding-up shaft, for winding up at least one web of the door leaf, has a suitable winding surface.

2. Prior Art

In particular in conjunction with the use in cold stores, it is known to heat components of doors. The heating here serves predominantly to avoid the formation of ice on various door components. Such ice formation usually results in malfunctioning of the door.

German patent number DE 196 25 215 C2 discloses a rolling door in which warm air coming from a heating device arranged in the upper region of the door flows through side parts of the rolling door, in which the lateral edges of the rolling-door leaf are guided. In addition, lower regions of the side parts contain openings through which the warm air can penetrate laterally into the rolling-door leaf when the rolling door is closed. The rolling-door leaf is formed from webs which enclose an interspace into which the warm air can penetrate. The warm air can rise upwards within this interspace and also heat the rolling-door leaf in the process.

One disadvantage with this solution is that the warm air, as it passes through the side parts, has already lost heat energy as soon as it reaches the interspace of the rolling-door leaf. Most of the rolling-door leaf, therefore, is heated possibly only to an insufficient extent and is kept ice-free only to an insufficient extent. In addition, it is also the case that, with the rolling door open, the warm air escapes from the openings and is then discharged ineffectively to the surroundings.

A fundamental disadvantage of rolling doors with flexible webs is that the operation of winding up these webs onto the winding-up shaft gives rise to unbalances. Despite the usually rotationally symmetrical winding surface of the winding-up shaft, the masses of the rotating overall structure made of the winding-up shaft and already partially wound-up rolling-door web are no longer distributed in a rotationally symmetrical manner in relation to the axis of rotation of the shaft. The already wound-up portion of the rolling-door web causes this non-symmetrical mass distribution.

BRIEF SUMMARY OF THE INVENTION

Taking this as the departure point, it is an object of the present invention to specify a door, a door leaf and a winding-up shaft of the type mentioned in the introduction which are particularly reliable to use.

This object is achieved by a door for closing an opening in a wall, preferably a wall separating two different temperature zones from one another, in particular one belonging to a cold store, having a door leaf, which can be moved in front of the wall opening, and having a heater for heating at least one door component, characterized in that the leaf of the door has arranged on it at least one preferably electrically operated door-leaf-heating device, preferably a radiant heater, which runs at least more or less parallel to the front side or rear side of the door leaf and by means of which the door leaf and/or the surroundings of the door leaf can be heated at least in certain regions. This object also is achieved by a door leaf for a door, having a preferably electrically operated door-leaf-heating device, preferably a radiant heater, which runs parallel to the front side or rear side of the door leaf and by means of which the door leaf and/or the surroundings of the door leaf can be heated at least in certain regions.

Accordingly, a door according to the invention for closing an opening in a wall is characterized in that the leaf of the door has arranged on it at least one preferably electrically operated door-leaf-heating device and preferably a radiant heater, which runs at least more or less parallel to the front side and/or rear side of the door leaf and by means of which the door leaf and/or the surroundings of the door leaf can be heated at least in certain regions.

For the first time, therefore, it is the case that the leaf of doors is heated directly by a heating device assigned to the door leaf or arranged on the door leaf. This has the advantage over prior-art solutions that the heat is generated directly wherever it is required, that is to say on the door leaf, for de-icing purposes or for avoiding the formation of ice on the door leaf. The concept according to the invention of arranging the heating device directly on or in the door leaf can be used particularly preferably for rolling doors, in particular for high-speed rolling doors for cool stores. As an alternative, however, it is basically also conceivable to provide such door-leaf-heating devices for various other doors, for example for sliding doors.

As far as the door-leaf-heating device is concerned, it comprises at least one, usually more than one, heat generator. The heat generator or generators is or are advantageously designed such that they convert electric current into heat. Accordingly, the door-leaf-heating device in this case is supplied with electrical energy by a source of electrical energy or a power source. The power source here is usually arranged outside the door leaf, wherein an electrically conductive connection between the door-leaf-heating device and the separate power source is created via suitable electrical connecting means. The source of electrical energy is usually a conventional mains connection or has such a connection, although it may also be a (storage) battery, a generator or some other generator of power.

The door-leaf-heating device is expediently designed as a so-called electric radiant heater. Such a radiant heater usually comprises a multiplicity of heat generators which are arranged in a sheet-like structure, are each designed as electrical resistors and heat up when current flows.

In an advantageous embodiment of the invention, the door leaf has a plurality of layers, wherein the door-leaf-heating device is integrated in at least one layer. Expediently, at least one layer is formed by insulation made of heat-insulating material. This insulation ensures sufficiently good thermal separation of various temperature zones which the door is usually intended to separate from one another.

With the door installed as intended, the door-leaf-heating device is advantageously arranged, in relation to the insulating layer, on the side which is directed towards the colder temperature zone. As a result, the heating energy can act predominantly in the direction of the colder zone, i.e. in the direction of that side of the door leaf on which there is the greater risk of ice formation.

Of course, it is additionally also possible, in principle, for a heating device to be arranged on the other side of the insulating layer. This is recommended, for example, when there is also a risk of ice formation on that side of the door leaf which is adjacent to the warmer temperature zone. This would be conceivable, for example at least in theory, when the door closes an opening in an outer wall of a cold store. In the presence of low temperatures in winter, it is then not possible to rule out the possibility of that side of the door leaf which is oriented outwards, towards the surroundings of the cold store, also otherwise icing up.

In a further embodiment of the invention, the outer sides of the door leaf are formed by two spaced-apart layers, preferably made of plastics material, for example PVC. The at least one door-leaf-heating device and/or the insulating layer here are/is preferably arranged between these outer layers.

If the door is designed as a rolling door, preferably as a high-speed rolling door, the leaf of the rolling door advantageously has at least one flexible door-leaf web which can be wound up onto a winding-up shaft. The rolling door, however, usually has a plurality of such webs. At least one of the webs then comprises the door-leaf-heating device, preferably a radiant heater.

The web in which the door-leaf heater, preferably the radiant heater, is integrated may also comprise, in addition, an insulating layer. The insulating layer, however, may also be formed separately as a web in its own right.

According to a particular embodiment of the invention, the leaf of the rolling door comprises at least three flexible webs which are not connected to one another, namely two spaced-apart outer webs, which form the outer sides of the door leaf, and a radiant-heater web, which is arranged between the outer webs. These webs may then be wound up, for example, onto a common winding-up shaft. However, it is also possible to provide two or more winding-up shafts, wherein some of the webs are assigned to the one winding-up shaft and the rest of the webs are assigned to the other winding-up shaft. As far as the outer webs are concerned, they preferably each have a layer of plastics material and/or a layer of heat-insulating material.

In a further embodiment of the invention, the door leaf has at least five such flexible webs which are not connected to one another. In this embodiment, once again, two spaced-apart outer webs are provided. Two spaced-apart insulating webs made of heat-insulating material are arranged in the interspace between the outer webs. In addition, a radiant-heater web is arranged between one of the outer webs and the adjacent insulating web. It is expedient for the radiant-heater web here—as already explained above—to be arranged, in relation to the aforementioned insulating web, on the side which is directed towards the colder temperature zone.

The door leaf expediently has a lower termination part, on which the lower end regions or the lower end edges of the individual webs of the door leaf are fastened.

It is possible here for the termination part to have one or more contact sensors, in particular a contact strip, which, under mechanical action, emits a signal to a control unit of the door, this signal triggering the door to stop and/or to reverse its movement direction.

In a further embodiment of the invention, the door has two side parts, which are arranged on the wall-opening sides and in which a lateral periphery or a lateral edge of the door leaf is guided in each case. This lateral periphery, or this lateral edge, runs at least more or less vertically in the installed state of the door in each case.

The door preferably has an upper casing with an interior in which are arranged the at least one winding-up shaft and/or one or more other components, for example a control unit for controlling the door and/or a drive for driving the at least one winding-up shaft. The interior of the upper casing is in air-channelling connection with a cavity of the door leaf which can be heated by the door-leaf-heating device, and therefore heated air located in the cavity of the door leaf can flow into the upper-casing interior.

For example, in the case of the above described embodiment of the invention with the rolling-door leaf having a plurality of webs, some of the heat from the radiant heater will penetrate into the interspace between outer webs, and possibly also into the interspace between the insulating layers, and will rise upwards and flow into the upper-casing interior.

The upper-casing interior is advantageously in air-channelling connection in each case with an interior of the side parts, and therefore heated air can flow out of the upper-casing interior into the respective side-part interior.

The object according to the invention is also achieved by a further independent special feature of the invention, namely by a winding-up shaft for winding up a door leaf or parts of a leaf of a rolling door for closing an opening in a wall, wherein the winding-up shaft, for winding up at least one web of the door leaf, has a suitable winding surface, characterized in that the winding surface, for the purpose of avoiding or reducing unbalances during the operation of winding up the door-leaf web, has a first surface region which, in relation to the axis of rotation of the winding-up shaft, is arranged further inwards in the radial direction than a second surface region.

Such a winding-up shaft has a winding surface which, for the purpose of avoiding unbalances during the operations of winding up and unwinding at least one door-leaf web, has a first surface region which, in relation to the axis of rotation of the winding-up shaft, is arranged further inwards in the radial direction than a second surface region. This means that, with the door leaf, in particular the upper edge thereof, fastened suitably on the winding-up shaft, the overall structure made up of the door-leaf web and the winding-up shaft deviates from the ideal rotationally symmetrical shape to a lesser extent than would be the case if use were made of conventional, rotationally symmetrical, in particular cylindrical, winding surfaces.

Accordingly, the winding surface is preferably designed such that, with the door leaf wound up in part, the overall structure made up of the winding-up shaft and partially wound-up door leaf is at least more or less rotationally symmetrical in relation to the axis of rotation of the winding-up shaft, in particular it is at least more or less cylindrical.

The upper edge of the door-leaf web, for this purpose, can be fastened in or on the radially further inward region of the winding surface. With an appropriate design of the winding-up shaft, it is then possible to achieve a situation where the radial distance between the radially outward surface or side of the door-leaf web in this fastened region and the axis of rotation of the winding-up shaft is more or less identical to the distance of that surface region which is offset by 180° in relation to the fastening region.

The radially further inward surface region of the winding surface, in a first circumferential direction of the winding-up shaft, preferably merges in an essentially transition-free manner into the radially further outward surface region, preferably in that—as seen in cross section—the respective radial distances of the winding surface from the axis of rotation increase continuously, at least in certain sections, preferably along the entire circumference in this first circumferential direction from the radially further inward region to the radially further outward region.

In the other, opposite circumferential direction, the radially further inward surface region and the radially further outward surface region are preferably connected to one another by an offset. The offset runs preferably at an angle, in particular more or less perpendicularly, to those regions of the winding surface which are adjacent to the offset. The height, or the corresponding dimension, of the offset here is expediently equal to or greater than the thickness of the door-leaf web which can be wound up onto the winding-up shaft. In the case of a plurality of door-leaf webs which can be wound up onto the winding-up shaft, the height of the offset here is expediently equal to or greater than the sum of the thicknesses of the individual door-leaf webs.

BRIEF DESCRIPTION OF THE DRAWINGS

Further features of the present invention can be gathered from the accompanying patent claims, from the following description of a preferred exemplary embodiment and from the accompanying drawings, in which:

DETAILED DESCRIPTION OF PREFERRED EMBODIMENTS

Figure 1A:
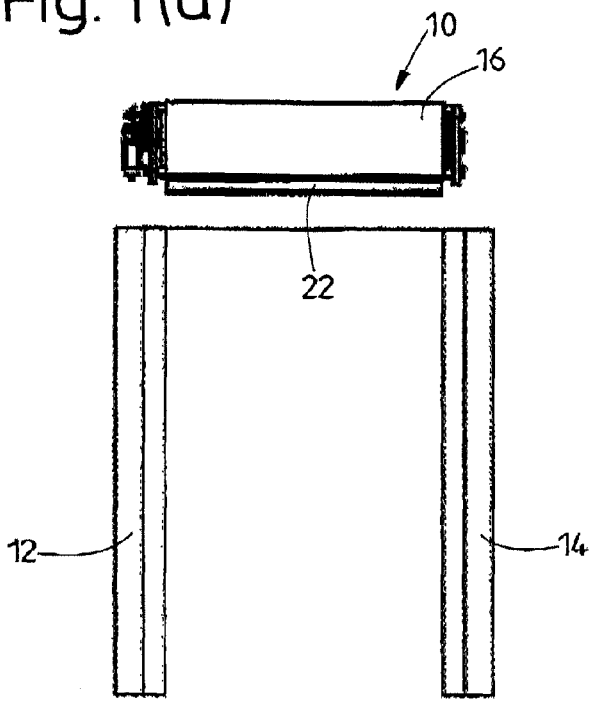
FIG. 1(*a*) shows a schematic front view of a door according to the invention with the upper part separated from the side parts, FIG. 1(*b*) shows a side view, partly in section, of the door from FIG. 1(*a*), FIG. 1(*c*) shows a horizontal longitudinal section through the door from FIGS. 1(*a*) to 1(*b*), FIG. 2(*a*) shows a vertical section through the leaf of the door from FIGS. 1(*a*) to 1(*c*) in the unwound state, FIG. 2(*b*) shows a front view of the door leaf from FIG. 2(*a*)

FIGS. 1 to 5 show a door 10 according to the invention, namely a so-called high-speed rolling door.

The door 10 serves for the temporary closure and/or release of an opening (not illustrated) in a wall (not illustrated), for example in an outer wall of a building, preferably of a deep-freeze store.

Temperatures of well below zero prevail in such a deep-freeze store. Deep-freeze stores make use of high-speed rolling doors in order for it to be possible for the times during which the closable openings are released, in order to allow for example fork-lift trucks to pass through the openings, to be kept as short as possible. This is because, with the door open, a large amount of heat energy penetrates into the deep-freeze store on account of the usually pronounced temperature gradient between the interior of this store and the exterior surroundings. This is to be avoided. One problem with such high-speed rolling doors in deep-freeze stores is that the individual components of the doors ice up quickly. Icing up may result in malfunctioning.

Icing up is largely avoided in the case of the door 10 according to the invention.

The door 10 has side parts 12, 14, which are installed in the region of the vertical peripheries or sides of the wall opening (not illustrated). For this purpose, the side parts 12, 14 have self-supporting carrying or installation framework structures (not shown specifically).

The upper region of the wall opening has arranged in it an upper part or an upper casing 16 which runs parallel to the upper edge of the wall opening and, in the installed state, is (also) borne by the side parts 12, 14. In other words, the upper part 16 connects the side parts 12, 14 by resting on the upper sides of the side parts 12, 14.

The interior of the upper part 16 contains various subassemblies of the door 10, for example two winding-up shafts 18, 20, which are spaced apart horizontally and parallel to one another. Individual webs of a flexible door leaf 22 are wound up in each case onto these winding-up shafts 18, 20 in order to open the door 10 and unwound therefrom in order to close the same.

In order to make the winding-up shafts 18, 20 rotate in a suitable manner, in addition, a gear-mechanism device 24 with various driving gearwheels 26 is arranged in the upper part 16. Also present in the upper part is a preferably electric drive motor (not illustrated). It also contains a control unit, which controls, inter alia, the drive movements of the winding-up shafts 18, 20.

The door leaf 22 has individual webs 28*a*-28*e* which are not connected to one another. The webs 28*a-e*, in the unwound state of the door leaf 20, extend essentially over the entire free surface area of the wall opening, this surface area running between the side parts 12, 14 and the upper part 16. The webs 28*a*, 28*b* here are assigned to the winding-up shaft 18 and the webs 28*c*, 28*d* and 28*e* are assigned to the winding-up shaft 20. In other words, the webs 28*a*, 28*b* are wound up, if required, on the winding-up shaft 18 and the webs 28*c*, 28*d*, 28*e* are wound up on the winding-up shaft 20.

The front side 30 of the door leaf 22 is formed by the outer web 28*e*, and the rear side of the door leaf 22 is formed by the outer web 28*a*. The material of the two outer webs 28*a*, 28*e* in each case here is plastics material, preferably PVC.

In the installed state, the door leaf 22 is oriented such that the front side 30 or the outer web 28*e* is directed into the interior of the cold store (not illustrated), that is to say faces in the direction of the temperature zone which is colder than the exterior surroundings of the building.

The webs 28*b*, 28*c* are spaced apart from one another in the interspace between the front side 30 and the rear side 32 or between the outer webs 28*a*, 28*e*.

The webs 28*b* and 28*c* are designed as insulating webs, i.e. they consist, in the present case, of suitable flexible, heat-insulating material.

The web 28*d* is positioned between the insulating web 28*c* and the outer web 28*e*, or the front side of the door leaf 22, at a distance in each case from the aforementioned webs 28*c*, 28*e*. All of the webs 28*a*-28*e*, in the closed state of the door 10, run essentially parallel to one another.

The web 28*d* comprises a door-leaf-heating device. In the present case, the entire web 28*d* is designed as an electric radiant-heater web.

Electric radiant heaters are known in the prior art. They are based essentially on heat being generated by electrical resistors which form heat generators. These resistors have electric current flowing through them as required, as a result of which they give out heat in a known manner. Such radiant heaters with a sheet-like structure may be, for example, known carbon radiant heaters.

The radiant-heater web 28*d* is connected to a source of electric current (not illustrated) via suitable connections and suitable lines for conducting electric current. In the present case, the radiant-heater web 28*d* is connected to a transformer (not illustrated) or a power supply unit, which in turn is connected to a conventional mains connection of a higher-voltage mains system.

The aforementioned control unit can be used to control the supply of power to the radiant-heater web 28*d*, in particular the intensity of the current supplied and/or the duration and/or the corresponding points in time at which the power is supplied.

The electric radiant-heater web 28*d* ensures that the adjacent outer web 28*e* is heated on a permanent basis or as required. This effectively prevents the situation where ice can form on this outer web 28*e*.

A specific secondary effect is the fact that the radiant-heater web 28*d* likewise heats at least to a slight extent in each case the air in the interspaces between the individual webs 28*a* to 28*e*. The heated air rises upwards, in the interspaces, into the upper casing 16 and ensures that the relevant subassemblies, for example the gear-mechanism device 24, the driving gearwheels 26, the control unit (not illustrated) and the drive motor (not illustrated) also remain free of ice.

The lower edges 34, 36 of the outer webs 28*a*, 28*e* are fastened on a common, lower termination part 38. This termination part 38, in the present case, is designed as an elongate plastics-material profile which, in the closed state of the door 10, forms the lower termination of the door. In other words, the termination part 38 preferably has its underside 40 resting on the ground, which bounds the building opening in the downward direction, or alternatively it hangs just above the ground, at a small distance therefrom.

The vertical, lateral edges 42, 44 of the door leaf 22, namely the lateral edges of the outer webs 28*a*, 28*e*, are guided in corresponding vertical guides of the side parts 12, 14, these guides not being shown explicitly in the drawings.

Provision may also be made, if appropriate, for electric radiant heaters or other heating devices to be arranged on the side parts 12, 14, and to be positioned such that at least the guides of the side parts 12, 14 are heated.

For the purpose of weighting the insulating layers 28*b*, 28*c*, in addition, steel profiles 46, 48, which are U-shaped in section, are arranged at the ends of these layers.

For the purpose of absorbing impact which may arise, for example, from fork-lift trucks accidentally colliding with the door leaf 22, both the front side 30 and the rear side 32 of the door leaf 22 have arranged on them respective bumpers 47 and 49, the latter running parallel to these sides in each case. These bumpers 47, 49 are preferably formed from elastic material, in particular from rubber, elastic plastics material or the like. They extend in each case preferably more or less parallel to the cold-store floor, essentially from the one lateral door-leaf edge 42 to the other lateral door-leaf edge 44, wherein they maintain a small distance from the door-leaf edges 42, 44. In concrete terms, they are each fastened on the respective outer sides of the termination part 38 of the door leaf 22, and in the present example they are connected thereto in a form-fitting manner.

Figure 1B:
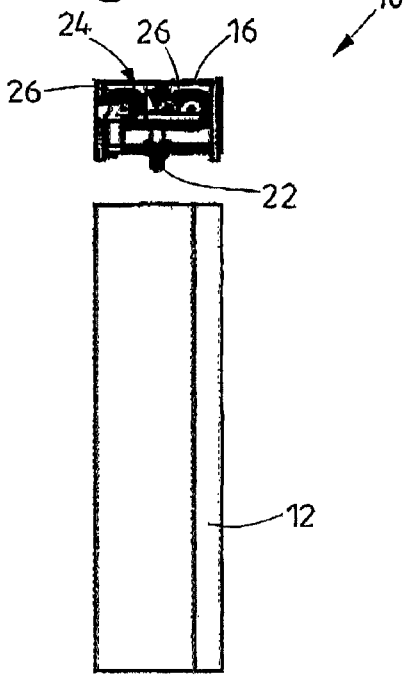
Figure 1C:
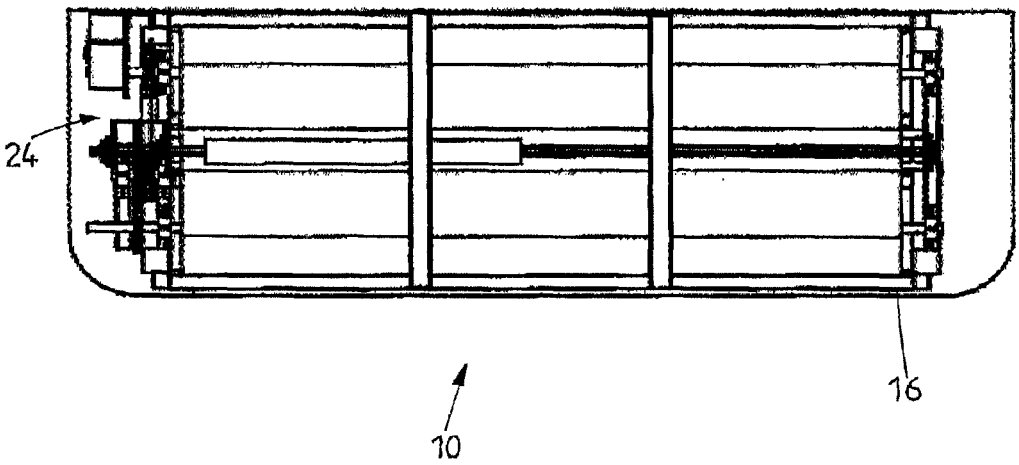
Figure 2B:
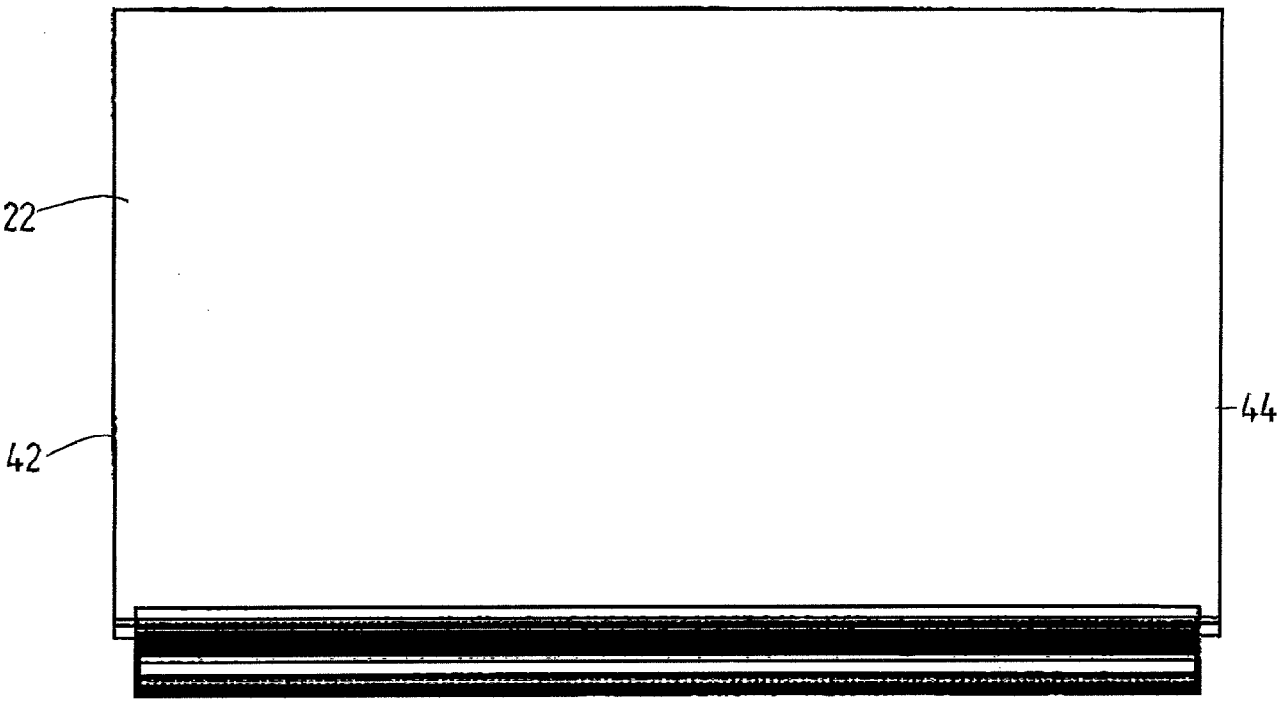
Figure 2A:
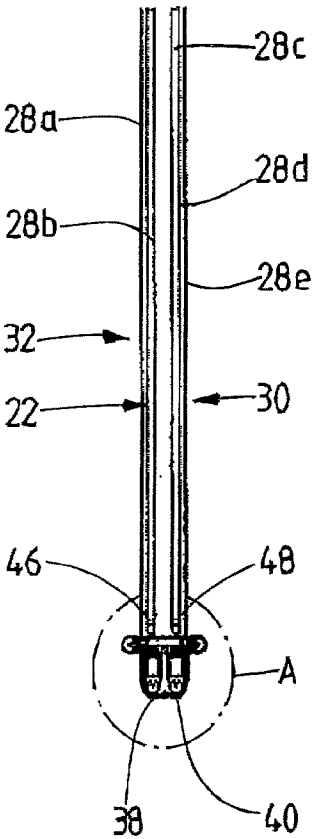
Figure 3:
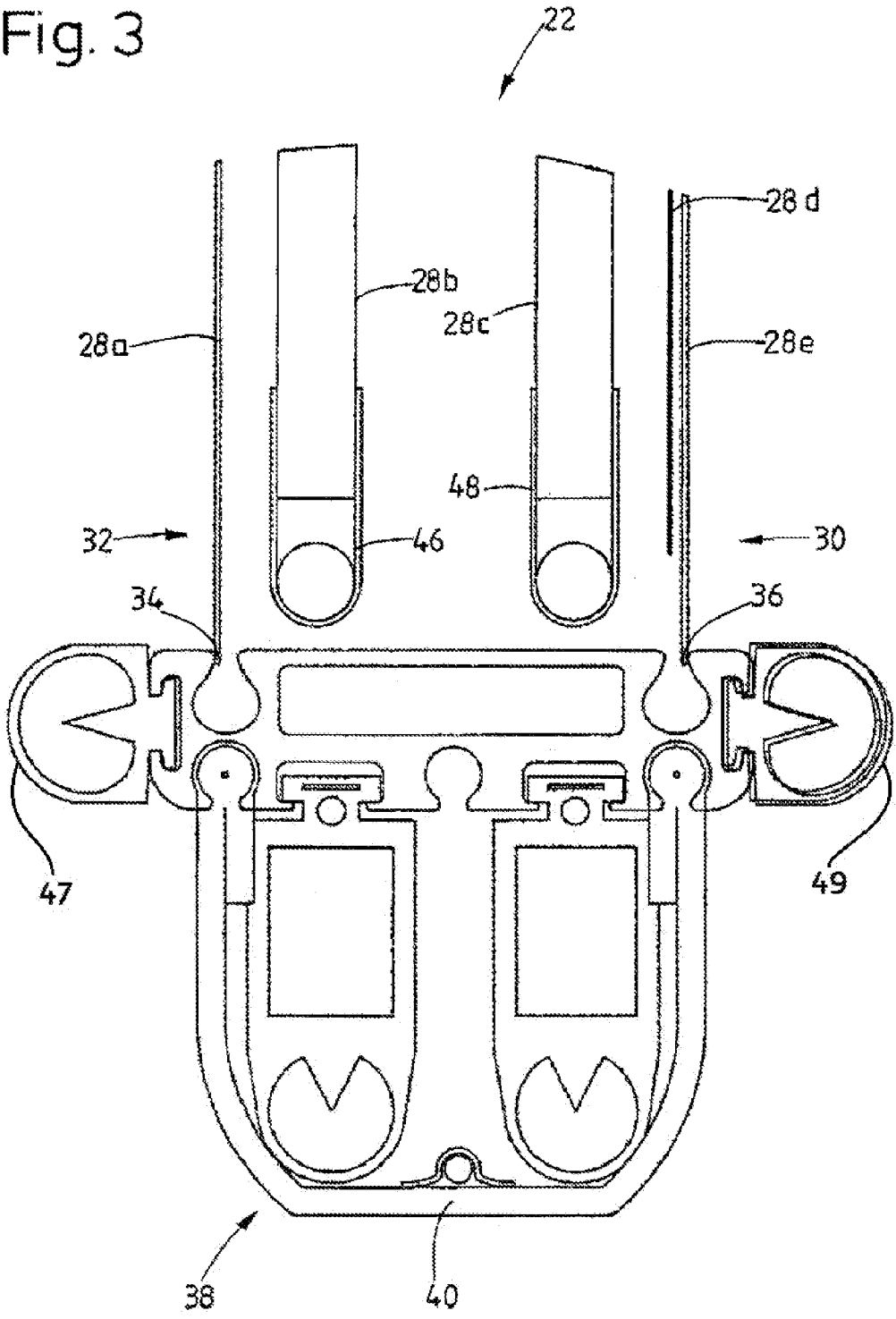
FIG. 3 shows the detail A from FIG. 2(*a*)
Figure 4:
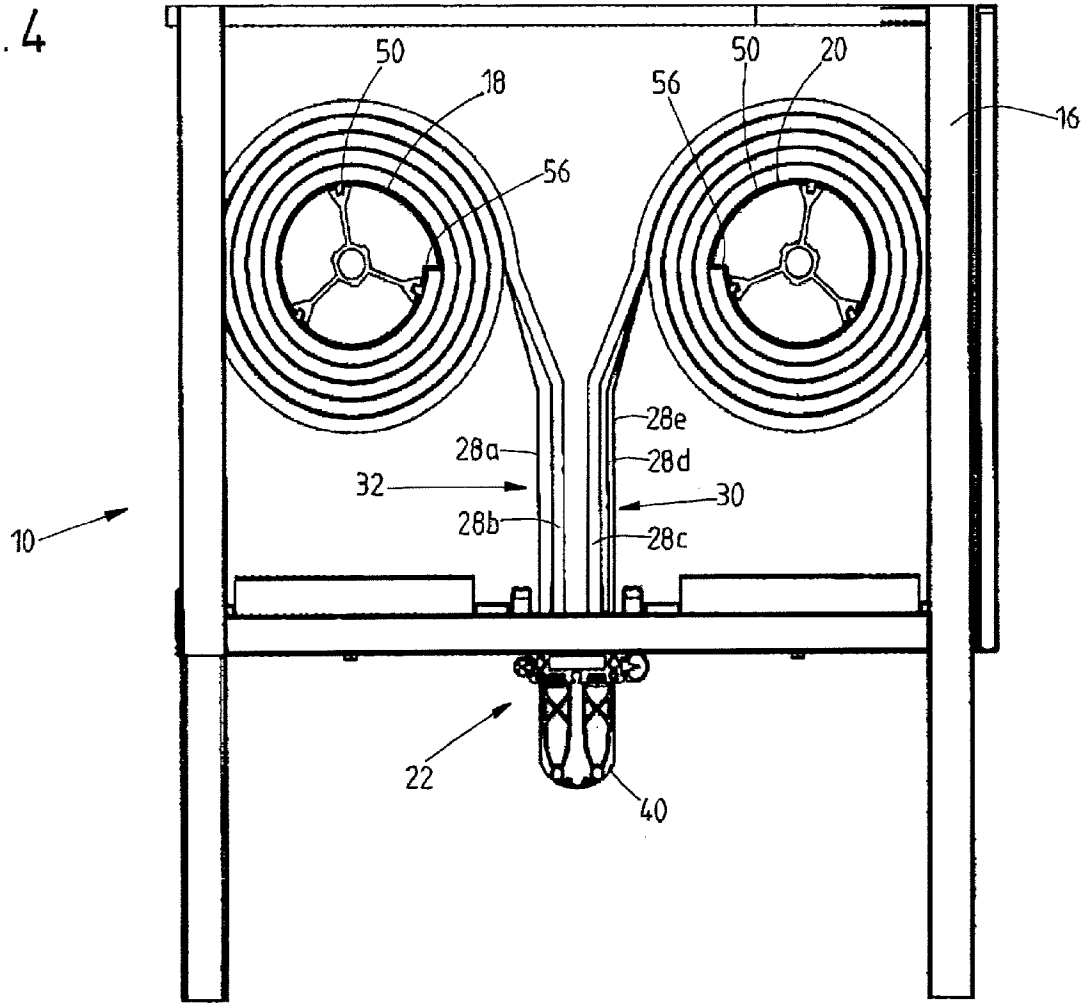
FIG. 4 shows a cross section through the upper part of the door from FIGS. 1(*a*) to (*c*)
Figure 5:
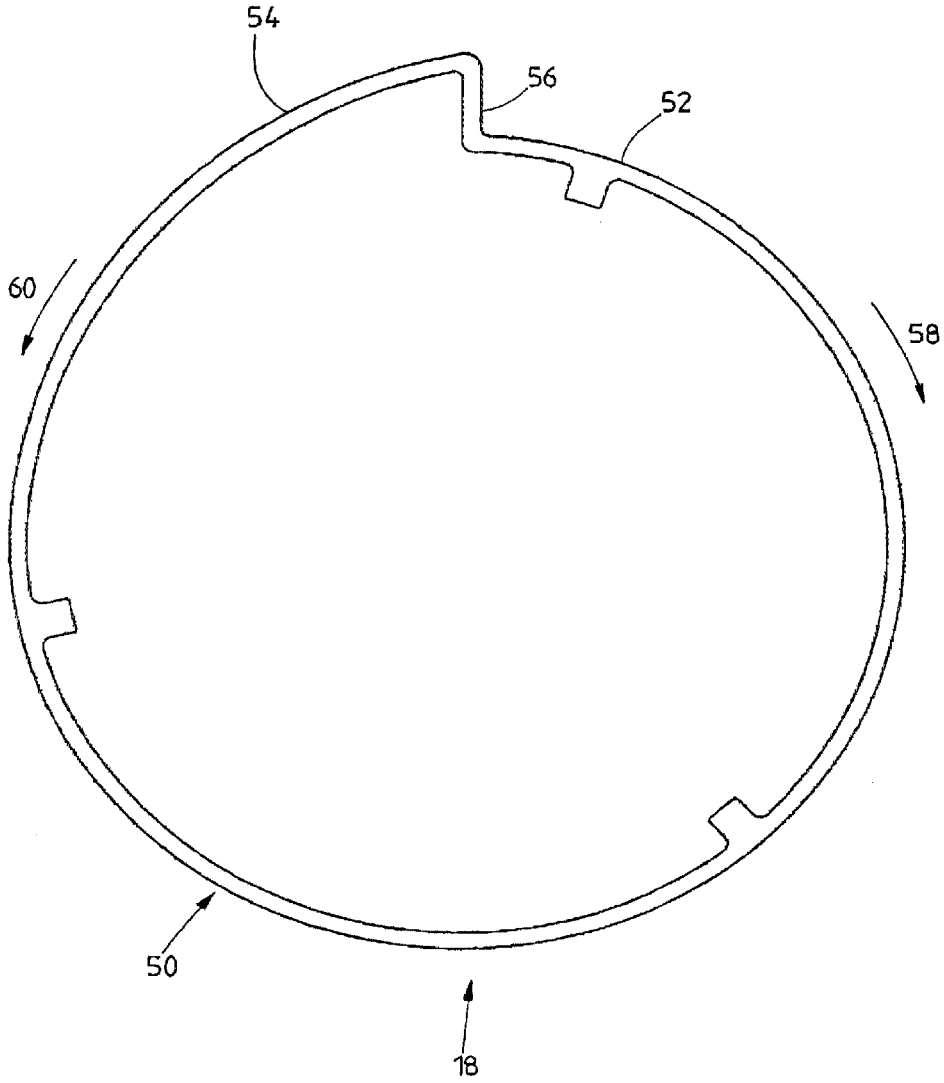
FIG. 5 shows a schematic illustration of a winding-up shaft of the door from FIGS. 1 to 4.

A further special feature of the invention relates to the winding-up shafts 18, 20:

FIG. 1 illustrates the winding-up shaft 18 in the form of a schematic diagram. The explanations which follow also apply analogously to the winding-up shaft 20.

The winding-up shaft 18 has a winding surface 50 which, in contrast to the prior art, is not cylindrical, i.e. is not rotationally symmetrical in relation to the axis of rotation, which is directed perpendicularly to the plane of the drawing. Rather, the winding-up shaft 18 has at least a first surface region 52, which is spaced apart radially from the axis of rotation by a smaller distance than at least a second surface region 54.

In the present example, in a first circumferential direction, namely in the clockwise direction (arrow 58), the first surface region 52 and the second surface region 54 are connected to one another in a continuous and transition-free manner. Accordingly, these regions merge into one another in a transition-free manner.

For this purpose, correspondingly, the distance of the winding surface 50 increases continuously in this circumferential direction from the surface region 52 to the surface region 54.

As seen in the opposite circumferential direction, i.e. in the anticlockwise direction (arrow 60), the surface regions 52, 54 are connected to one another by an offset 56. This offset 56 in the winding surface 50 runs more or less radially, but at least at an angle to the surface regions 52, 54, and runs longitudinally along the entire winding-up shaft 18.

The height or the corresponding radial dimension of the offset 56, in the present case, is somewhat greater than the sum of the thicknesses of the door-leaf webs 28*a*, 28*b* which can be wound up onto the winding-up shaft 18. This can be seen particularly clearly in FIG. 4.

The upper edges of the door-leaf webs 28*a*, 28*b* are fastened in the surface region 52 in a manner which is not illustrated, and therefore the door-leaf webs 28*a*, 28*b* which can be wound up have their upper edges in each case butting against the offset 56. These edges here run perpendicularly to the plane of the drawing, parallel to the offset 56.

The specific design of the winding surface 50 serves for avoiding unbalances during the operations of winding up and unwinding the door-leaf webs 28*a*, 28*b*. The overall structure made up of the door-leaf webs 28*a*, 28*b* and the winding-up shaft 18 deviates from the ideal rotationally symmetrical form, during the winding-up and unwinding operations, to a lesser extent than would be the case if use were made of conventional, rotationally symmetrical, in particular cylindrical, winding surfaces.

The same applies analogously—as already indicated above—to the winding-up shaft 20 and the door-leaf webs 28*c*, 28*d*, 28*e* which can be wound up thereon.

LIST OF DESIGNATIONS

10 Door
12 Side part
14 Side part
16 Upper part
18 Winding-up shaft
20 Winding-up shaft
22 Door leaf
24 Gear-mechanism device
26 Driving gearwheel
28*a*-28*e* Webs
30 Front side
32 Rear side
34 Edge
36 Edge
38 Termination part
40 Underside
42 Vertical, lateral edge
44 Vertical, lateral edge
46 Steel profile
47 Bumper
48 Steel profile
49 Bumper
50 Winding surface

52 First surface region
54 Second surface region
56 Offset
58 Arrow
60 Arrow

What is claimed is:

1. A rolling door (10) for closing an opening in a wall separating two different temperature zones from one another, one zone belonging to a cold store, comprising:

a door leaf (22), which can be moved in front of the wall opening, wherein the door leaf (22) comprises a plurality of layers (28*a-e*), wherein at least one of the layers (28*b, c*) is formed by insulation made of heat-insulating material, and a heater for heating at least one door component, wherein the door leaf (22) of the rolling door (10) comprises at least one electrically operated door-leaf-heating device integrated in at least one of the layers (28*d*), the at least one electrically operated door-leaf-heating device being a radiant heater that runs at least substantially parallel to a front side or rear side (30, 32) of the door leaf (22), and wherein the door leaf (22) is heated at least in certain regions by the at least one electrically operated door-leaf-heating device.

2. The rolling door according to claim 1, wherein, with the door (10) installed as intended, the door-leaf-heating device (28*d*) is arranged, in relation to the insulating layer (28*b, c*), on a side of the door (10) that is directed towards the colder temperature zone.

3. The rolling door according to claim 1, wherein the outer sides (30, 32) of the door leaf (22) are formed by two spaced-apart layers (28*a-e*) made of plastics material, and wherein the door-leaf-heating device (28*d*) and/or the insulating layer (28*b, c*) are/is arranged between the outer layers (28*a, e*).

4. The rolling door according to claim 1, wherein the door (10) is a rolling door, of which the door leaf (22) has at least one flexible web (28*b, c, d*) that can be wound up on a winding-up shaft (18, 20) and comprises the insulating layer and/or a door-leaf-heating device (28*d*) designed as a radiant heater.

5. The rolling door according to claim 3, wherein the door leaf (22) comprises at least three flexible webs (28*a-e*) which are not connected to one another, namely two spaced-apart outer webs (28*a, e*) each having a layer of plastics material and/or a layer of heat-insulating material and forming the outer sides (30, 32) of the door leaf (22), and a radiant-heater web (28*d*), which is arranged between the outer webs (28*a,e*).

6. The rolling door according to claim 3, characterized in that the door leaf (22) comprises at least five flexible webs (28*a-e*) which are not connected to one another, namely two spaced-apart outer webs (28*a, e*) made of plastics material and forming the outer sides (30, 32) of the door leaf (22), two spaced-apart insulating webs (28*b, c*), which are arranged in the interspace between the outer webs (28*a, e*), and a radiant-heater web (28*d*), which is arranged between one of the outer webs (28*a, e*) and the adjacent insulating web (28*c*).

7. The rolling door according to claim 3, wherein the door leaf (22) has a lower termination part (38), on which at least one web (28*a, e*) of the door leaf (22) is fastened.

8. The rolling door according to claim 7, wherein the termination part (38) has at least one contact sensor, which, under mechanical action, emits a signal to a control unit of the door (10), the signal triggering the door to stop and/or to reverse its movement direction.

9. The rolling door according to claim 3, wherein the door (10) has at least two parallel, spaced-apart winding-up shafts (18, 20), arranged above the wall opening or in the upper region of the wall opening, wherein at least one of the door-leaf webs (28*a, b*) is assigned to the one winding-up shaft (18) and at least one of the door-leaf webs (28*c-e*) is assigned to the other winding-up shaft (20).

10. The rolling door according to claim 1, wherein the door (10) has two side parts (12, 14), which are arranged on the opening sides and in which a lateral periphery (42, 44) of the door leaf (22) is guided in each case.

11. The rolling door according to claim 1, wherein the door (10) has an upper casing (16) with an interior in which are arranged at least one winding-up shaft (18, 20) and/or at least one other components selected from the group consisting of a control unit for controlling the door and a drive for driving the at least one winding-up shaft, wherein the interior of the upper casing (16) is in air-channeling connection with a cavity of the door leaf (22) which can be heated by the door-leaf-heating device (28*d*), and therefore heated air located in the cavity of the door leaf (22) can flow into the upper-casing interior.

12. The rolling door according to claim 11, wherein the upper-casing interior is in air-channeling connection in each case to an interior of the side parts (12, 14), and therefore heated air can flow out of the upper casing interior into the respective side-part interior.

13. A door leaf for a rolling door (10), the rolling door (10) for closing an opening in a wall separating two different temperature zones from one another, one zone belonging to a cold store, wherein the door leaf can be moved in front of the wall opening, the door leaf comprising:

a plurality of layers (28*a-e*), wherein at least one of the layers (28*b, c*) is formed by insulation made of heat-insulating material; and an electrically operated door-leaf-heating device integrated in at least one of the layers (28*d*), the electrically-operated door-leaf-heating device comprising a radiant heater which runs parallel to a front side or rear side (30, 32) of the door leaf, wherein the door leaf (22) and/or the surroundings of the door leaf (22) are heated at least in certain regions.

* * * * *